United States Patent [19]

Wagner

[11] 4,246,711

[45] Jan. 27, 1981

[54] MILK CARTON DISPLAY ATTACHMENT

[75] Inventor: Kenneth E. Wagner, Williamsville, N.Y.

[73] Assignee: Carton-Craft Corp., Buffalo, N.Y.

[21] Appl. No.: 27,256

[22] Filed: Apr. 5, 1979

[51] Int. Cl.[3] ..... G09F 1/00

[52] U.S. Cl. ..... 40/312; 40/124.1; 40/310; 40/21 B

[58] Field of Search ..... 40/124.1, 306, 21 R, 40/21 B, 584, 310, 312

[56] References Cited

U.S. PATENT DOCUMENTS

| | | | |
|---|---|---|---|
| 1,348,899 | 8/1920 | Sargent | 40/21 B |
| 1,458,169 | 6/1923 | Dietsche | 40/306 |
| 2,651,862 | 9/1953 | Fine | 40/584 X |

FOREIGN PATENT DOCUMENTS

| | | | |
|---|---|---|---|
| 452120 | 8/1936 | United Kingdom | 40/21 R |

*Primary Examiner*—Gene Mancene
*Assistant Examiner*—Wenceslao J. Contreras
*Attorney, Agent, or Firm*—Christel, Bean & Linihan

[57] ABSTRACT

This invention relates to a display device for attachment to a gable-topped cardboard container of the type employed in packaging milk and the like. The display device comprises a hollow square sleeve which telescopes over the top of the carton and a display panel hinged to the upper portion of the sleeve and having a triangular opening adapted to fit over the gable-top of the carton. The device is fabricated from a single cardboard blank and is readily placed in a flat folded condition for storage and shipment.

1 Claim, 4 Drawing Figures

MILK CARTON DISPLAY ATTACHMENT

BACKGROUND OF THE INVENTION

This invention relates to an accessory for conventional cardboard containers such as are used for milk or other beverages. The accessory bears advertising or other identifying indicia and is applied to the conventional gable-tops of such containers.

Attachments for similar purposes have been previously proposed but the construction and the manner of application of prior art attachments of this general type have been substantially different. The closest prior art devices known to applicant are shown and described in U.S. Pat. Nos. 2,651,862; 3,015,901; 3,016,644; and 3,380,181.

SUMMARY OF THE INVENTION

The display attachment of the present invention comprises as its two principal components a sleeve portion adapted to fold flat or be placed in square formation to fit over the upper end of a conventional milk carton in telescoping fashion, together with a display panel which extends obliquely upwardly from the sleeve portion when the device is in assembled position on a carton in a manner which will presently appear.

DESCRIPTION OF THE ILLUSTRATED EMBODIMENT

Figure 3:
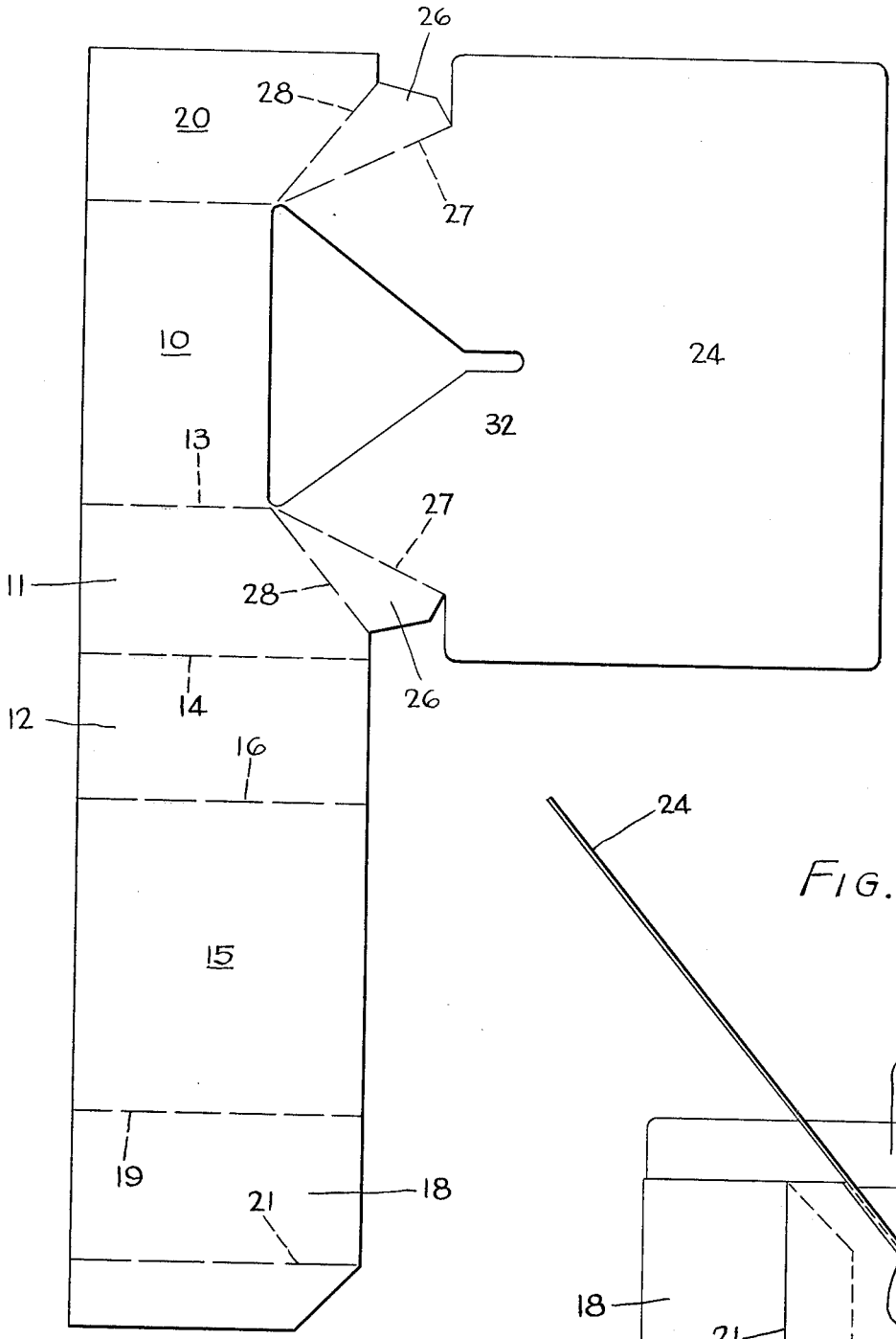
FIG. 3 shows the one-piece cardboard blank from which devices of the present invention are formed.

It is believed that the construction and manner of assembly and use of the exemplary form of the present invention will best be understood by referring first to the one-piece cardboard blank shown in FIG. 3. Referring first to the lefthand portion of the blank illustrated in FIG. 3, which is actually the bottom portion of the blank, the numeral 10 designates the front panel of the square sleeve which is applied over the carton, the numerals 11 and 12 designate the right side panel which is connected to front panel 10 by a score line 13 and is itself medially divided by a score line 14 for a folding purpose which will presently appear.

The rear wall of the sleeve portion of the blank is designated 15 in FIG. 3 and is divided from the righthand side wall 11, 12 by a score line 16. The lefthand side wall of the sleeve is made up of the end portions of the blank, that is, the portion 18 which is connected to rear wall 15 by a score line 19 and the opposite end of the blank which is designated 20 in FIG. 3 and is connected to front wall 10 by a score line 23.

The portion 18 and 20 overlap and are adhesively secured to each other and the portion 18 has a score line 21 which divides the lefthand side wall of the sleeve vertically and corresponds to the score line 14 of the righthand side wall portion 11, 12 of the blank, likewise for a folding or knockdown operation of the sleeve portion. As shown in the lefthand side view in FIG. 4, the end portion 20 of the blank coincides with the score line 21 of the opposite end portion 18 of the blank.

Figure 2:
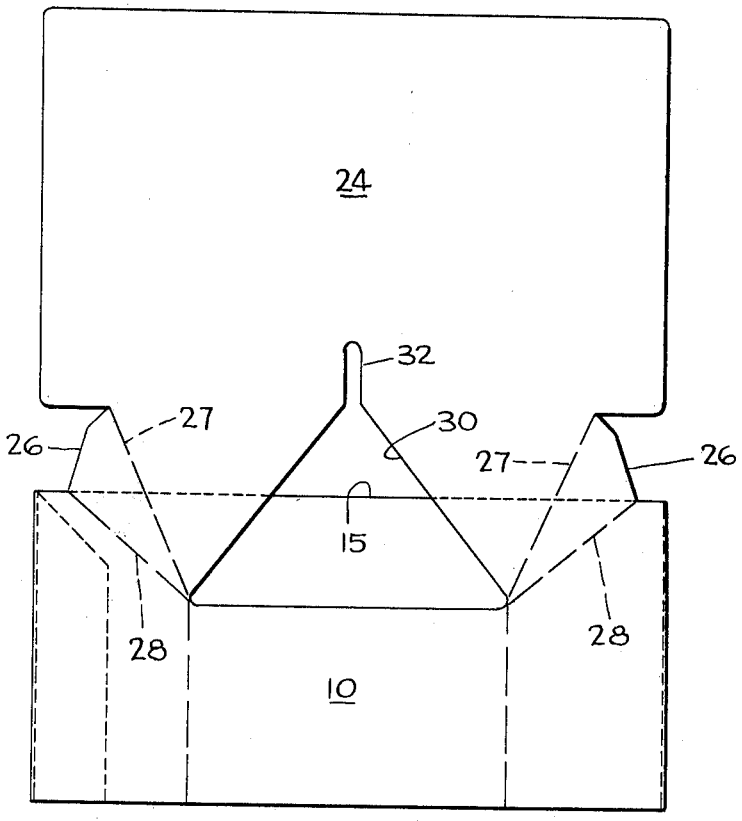
FIG. 2 is a front view of the attachment of the present invention folded flat in the condition in which it is delivered from the manufacturer to the packager and before its application to a carton.

When the lefthand end wall 18, 20 of the sleeve portion is adhesively secured as described above the device may, by virtue of the score lines 14 and 21, be placed in the flat-folded condition illustrated in FIG. 2. The display panel is generally rectangular and is designated 24 in the drawings. Any desired identification or advertising material may be provided on the face of panel 24 which is uppermost in FIGS. 2 and 3. As shown in FIGS. 2 and 3, the panel 24 is connected to the sleeve-forming portions of the blank by a pair of triangular gusset portions 26 which connect with the display panel 24 by score lines 27 and with the sleeve forming portions by score lines 28.

Figure 1:
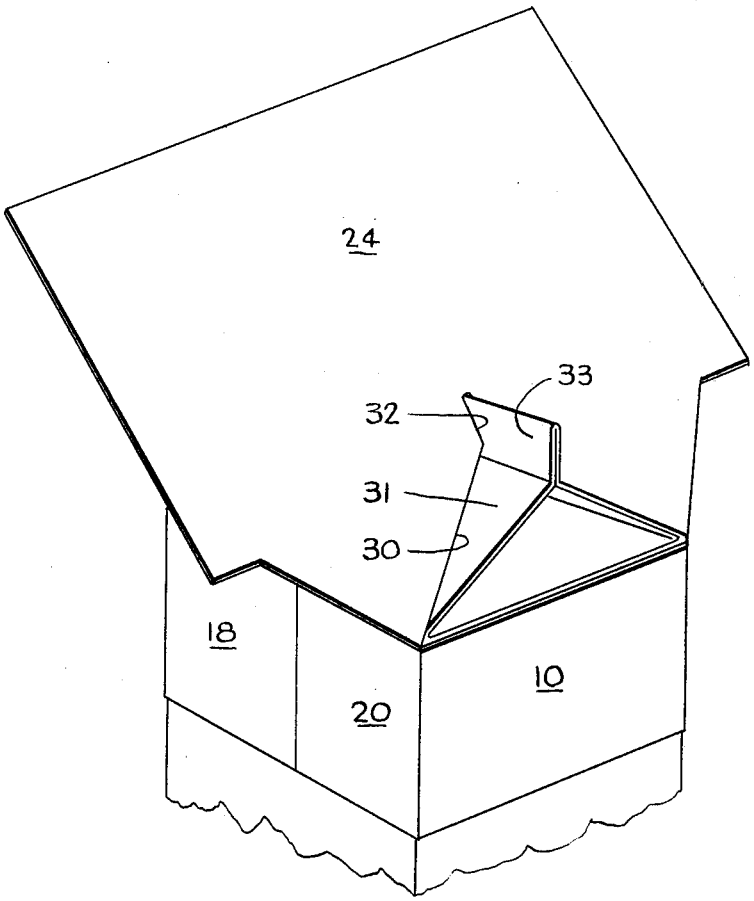
FIG. 1 is a fragmentary perspective view of the upper end of a conventional gable-top milk carton with one form of the device of the present invention applied thereto.
Figure 4:
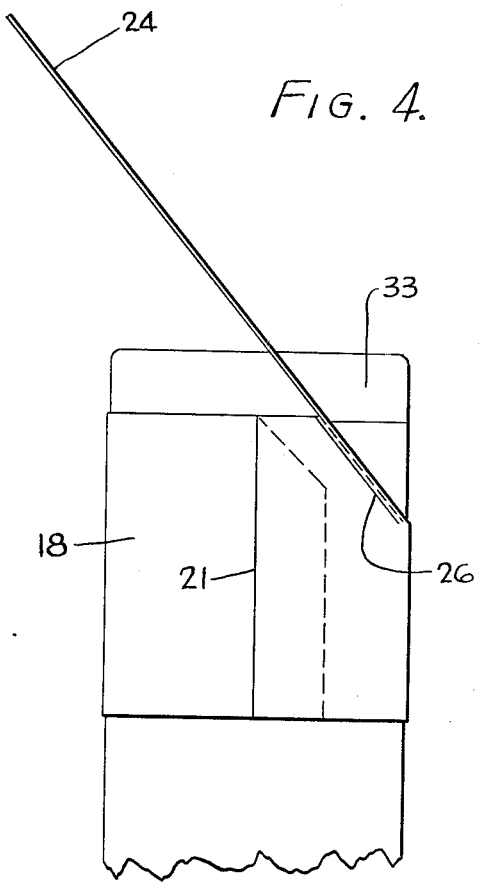
FIG. 4 is a side elevational view of the upper end of a carton with the device of the present invention applied thereto, viewed from the lefthand side of FIG. 1.

This arrangement provides a triangular opening 30 in the display panel 24 which, when the sleeve portion is assembled over a milk carton, permits the display panel to be inclined rearwardly with the opening 30 disposed over the conventional gable-top of the carton shown at 31 in FIGS. 1 and 4. A slot extension 32 fits snugly over the upper flange portion 33 of the carton and thus frictionally retains panel 24 in the rearwardly incllined position shown in FIG. 1. During the rearward inclination of panel 24 the gussets 26 fold beneath panel 24 and lie against its under surface.

A preferred embodiment of this invention having been hereinabove described and illustrated in the drawings, it is to be understood that numerous modifications thereof can be made without departing from the broad spirit and scope of this invention as defined in the appended claims.

I claim:

1. A cardboard display device adapted to be mounted upon the upper end of a conventional gable-topped carton for milk and the like, said device being formed from a blank having a mounting portion and a display panel portion, the mounting portion comprising a sleeve adapted to telescope downwardly over a milk carton, the display panel being hinged to said mounting portion and having a triangular opening adapted to engage over the conventional gable-top of said carton when the display panel is inclined rearwardly, said triangular opening having a slot extension adapted to engage frictionally the usual vertical flange of conventional cartons of this type, said display panel being connected to said sleeve by triangular gussets hinged to said display panel and said sleeve by score lines, said gussets being adapted to fold under said display panel when the latter is moved rearwardly to assembled position on a carton.

* * * * *